US007150140B2

(12) United States Patent
Harmon

(10) Patent No.: US 7,150,140 B2
(45) Date of Patent: Dec. 19, 2006

(54) DEVICE FOR TWISTING DECORATIVE MATERIALS

(76) Inventor: Lary Harmon, 524 F Via De La Valle, Solana Beach, CA (US) 92075

( * ) Notice: Subject to any disclaimer, the term of this patent is extended or adjusted under 35 U.S.C. 154(b) by 10 days.

(21) Appl. No.: 11/034,333

(22) Filed: Jan. 12, 2005

(65) Prior Publication Data

US 2006/0070368 A1 Apr. 6, 2006

Related U.S. Application Data

(63) Continuation of application No. 10/273,243, filed on Oct. 17, 2002, now abandoned, which is a continuation-in-part of application No. 09/737,022, filed on Dec. 13, 2000, now abandoned.

(51) Int. Cl.
*D01H 7/02* (2006.01)

(52) U.S. Cl. ..... 57/59

(58) Field of Classification Search ..... 57/1 R, 57/59–65, 314
See application file for complete search history.

(56) References Cited

U.S. PATENT DOCUMENTS

| | | | | | |
|---|---|---|---|---|---|
| 70,466 | A | * | 11/1867 | Perkins | 57/65 |
| 187,306 | A | * | 2/1877 | Peacock | 57/62 |
| 1,120,575 | A | * | 12/1914 | Wertz | 140/118 |
| 1,733,148 | A | * | 10/1929 | Bulkley et al. | 140/119 |
| 2,649,042 | A | * | 8/1953 | Wickman | 99/441 |
| 4,065,080 | A | * | 12/1977 | Alison | 244/155 A |
| 4,580,585 | A | * | 4/1986 | Sapkus | 132/212 |
| 6,164,289 | A | * | 12/2000 | Ogunro et al. | 132/210 |
| 6,321,519 | B1 | * | 11/2001 | Goertz | 57/3 |
| 2002/0028738 | A1 | * | 3/2002 | Harmon | 493/442 |

OTHER PUBLICATIONS http://familyfun.go.com/parties/birthday/feature/party1/party3.html (Aug. 5, 2002).*

* cited by examiner

*Primary Examiner*—Shaun R. Hurley
(74) *Attorney, Agent, or Firm*—David B. Waller & Assoc.

(57) ABSTRACT

A device for twisting decorative material from rolls comprising a shaft having two ends, an attachment means for affixing at least one roll of decorative material provided on one end of said shaft, and a crank provided on the other end of said shaft.

3 Claims, 3 Drawing Sheets

A

B

DEVICE FOR TWISTING DECORATIVE MATERIALS

REFERENCE TO RELATED APPLICATIONS

This application is a continuation of patent application Ser. No. 10/273,243 filed 17 Oct. 2002 now abandoned which is a continuation-in-part application of patent application Ser. No. 09/737,022 filed 13 Dec. 2000 now abandoned.

TECHNICAL FIELD

The present invention relates to tools used in party preparation or decoration. In particular, the device may be utilized for intertwining and twisting decorative materials from rolls.

BACKGROUND OF THE INVENTION

Steamer paper, ribbons, garland and the like are materials often used for party decorations. They generally come in rolls of various widths and lengths, the most common range from less than one inch to 2½ inches wide. Typically, the consumer attaches the end of the decorative material to a structure and manually unravels the material from the roll. To make the decoration more interesting, the roll of streamer paper, ribbon or garland may be twisted to provide a spiral appearance. To further enhance the decorative appearance, the consumer may utilize two rolls of the decorative material of different colors and intertwine them. This operation creates a decorative spiral with alternating colors. The operation of unraveling and twisting one roll of the material requires both hands and can be very awkward and time consuming. The operation of unraveling, intertwining and twisting two rolls is even more awkward, more difficult and considerably more time consuming.

Currently, there are no devices available to assist one in decorating by intertwining and twisting material such as streamer paper, ribbon or garland from rolls. Devices for performing similar functions with wire are known in the art and include U.S. Pat. No. 218,741 to Campbell P. Higgins, which describes a hay bale wire-tying machine; U.S. Pat. No. 397,635 issued to Louis S. Flatau which describes a wire tightening device that takes up slack in and secures wire; U.S. Pat. No. 1,120,575 to John T. Wertz which describes a wire nipper and twister; and U.S. Pat. No. 1,733,148 to Roy C. Buckley et al. which describes a device used for stretching and twisting tie wire by clamping onto the wire. While all these devices may be used for twisting wire, none are adaptable to the operation of intertwining and twisting decorative materials, such as, for example, streamer paper, ribbon or garland.

Another U.S. Pat. No. 2,464,657, to Chester K. Stephenson describes a device for stretching, crimping, and twisting sheet material. This device comprises a pair of parallel bars interconnected at one end on which one end of the material is rolled and a pair of sliding members for crimping the material on the bars. The Stephenson device requires manually rotating the entire set of parallel bars in order to impart a twist in the sheet material. This device is designed for twisting large sheets of material and not adaptable to the operation of intertwining and twisting rolls of decorative materials.

Therefore, there is a need for a decorative material twisting device that provides a simple method for twisting and intertwining streamer paper, ribbon or garland materials from rolls.

SUMMARY OF THE INVENTION

The present invention provides a device for intertwining and twisting decorative materials, such as streamer paper, ribbon or garland, from rolls comprising a shaft having two ends, an attachment means for affixing at least one roll of the decorative material on one end of the shaft, and a crank on the other end.

In one embodiment of the invention, a device for intertwining and twisting decorative material from rolls is provided comprising a shaft having two ends, a T-shaped attachment means provided on one end of the shaft having a means for attaching at least one roll of decorative material, and a crank provided on the other end of the shaft.

In one aspect of this embodiment the attachment means comprises two or more rods positioned perpendicular to the shaft wherein each of said two or more rods having a securing means for holding one or more roll of the decorative material on said rods. The securing means may be a screw-on cap, a press-on cap, a spring clip or a cotter pin. Alternatively, the attachment means may comprise rods extending outward from the shaft at angles not less than 90 degrees and not greater than 135 degrees from the shaft.

In another aspect of this embodiment, the device may further comprise a gripping means positioned on the shaft between the attachment means and the crank to facilitate rotation of the shaft.

In yet another aspect of this embodiment the device may further comprise a storage means for tacks or push pins, an adapter for affixing at least one adhesive tape roll, and/or a means for storage of one or more roll of the decorative material. In still another aspect of this embodiment the attachment means may allow for storage of one or more rolls of the decorative material.

In another embodiment a method and a kit for decorating with rolls of decorative materials such as streamer paper, ribbon or garland are provided comprising a device of the present invention, a set of one or more roll of decorative material, and a means for affixing the decorative material to structures wherein the means for affixing may be tacks, push pins or adhesive tape.

DETAILED DESCRIPTION

Figure 1:
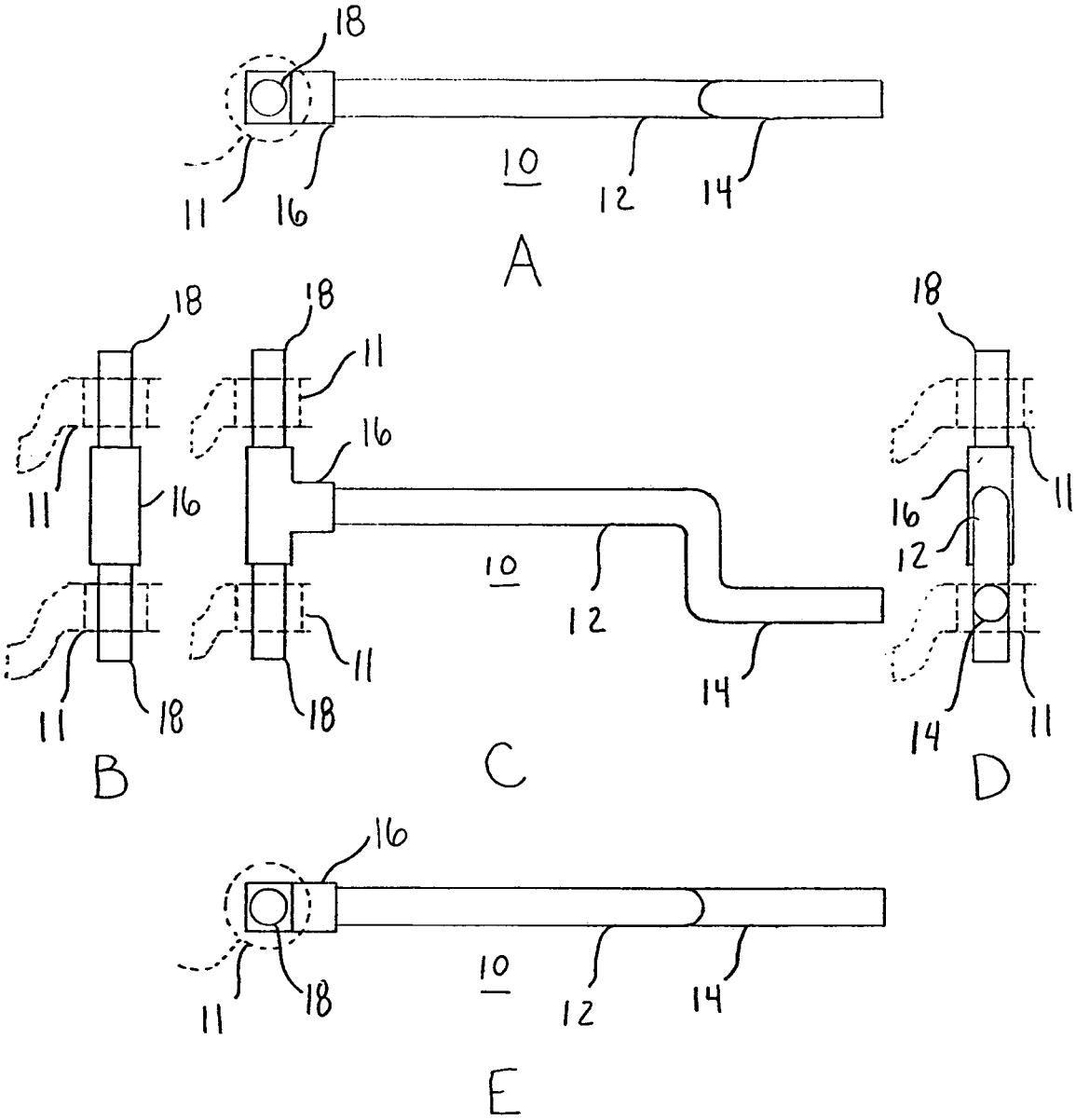
FIG. 1: Is a diagrammatic representation of one embodiment of the present invention showing (A) the left side view; (B) the front view; (C) the top view; (D) the back view; and (E) the right side view.
Figure 2:
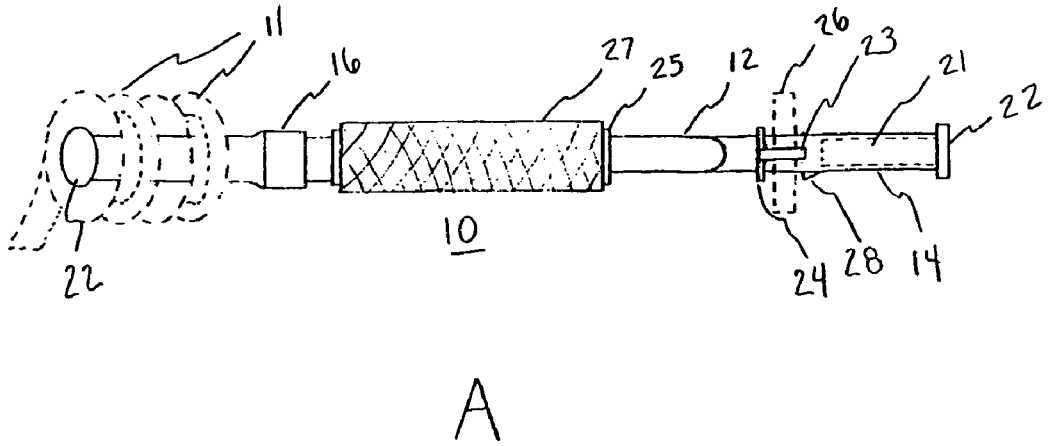
FIG. 2: Is a diagrammatic representation of one embodiment of the present invention comprising a gripping means and a storage means for adhesive tape, tacks and decorative material showing (A) the left side view; (B) the top view; and (C) the right side view.
Figure 2:
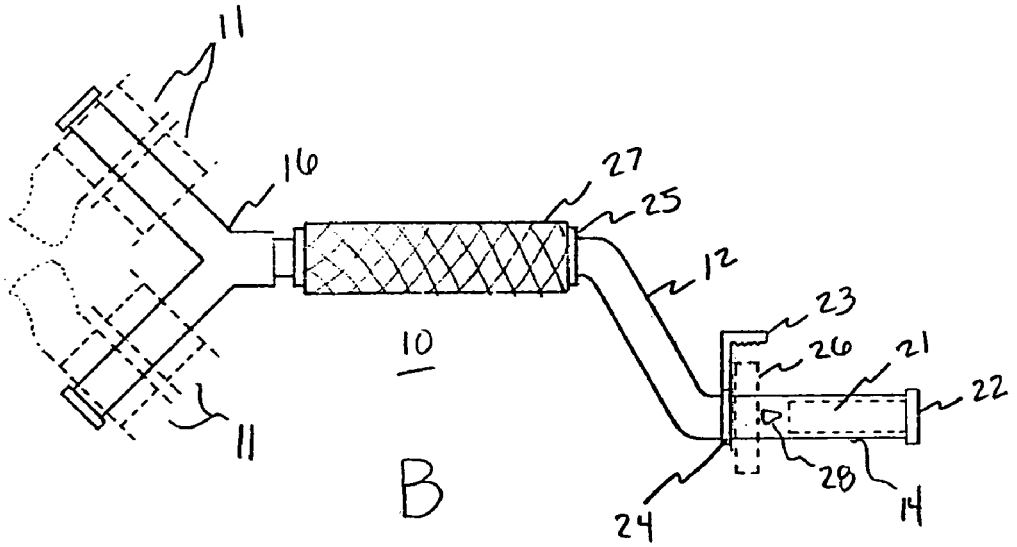
Figure 2:
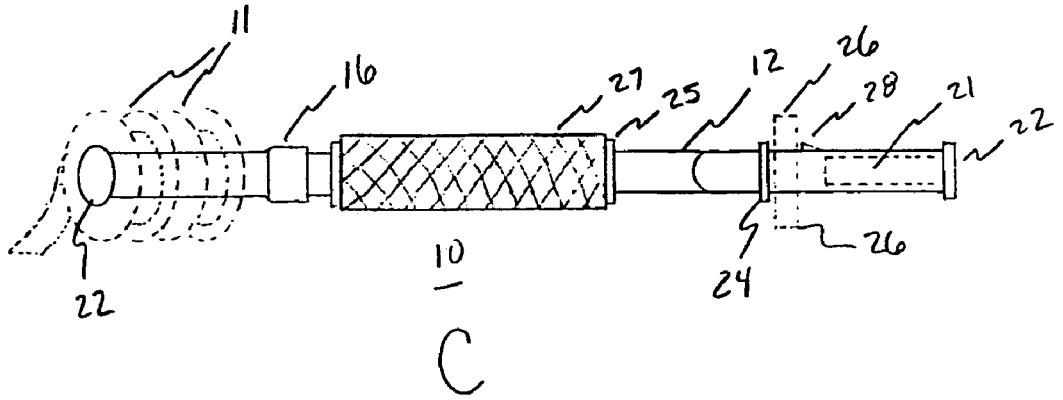
Figure 3:
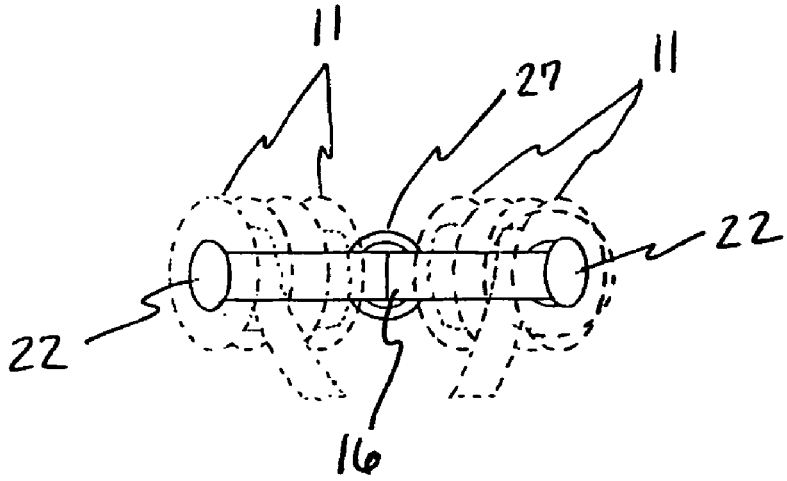
FIG. 3: Is a diagrammatic representation of one embodiment of the present invention comprising a gripping means and a storage means for adhesive tape, tacks and decorative material showing (A) the front view and (B) the back view.
Figure 3:
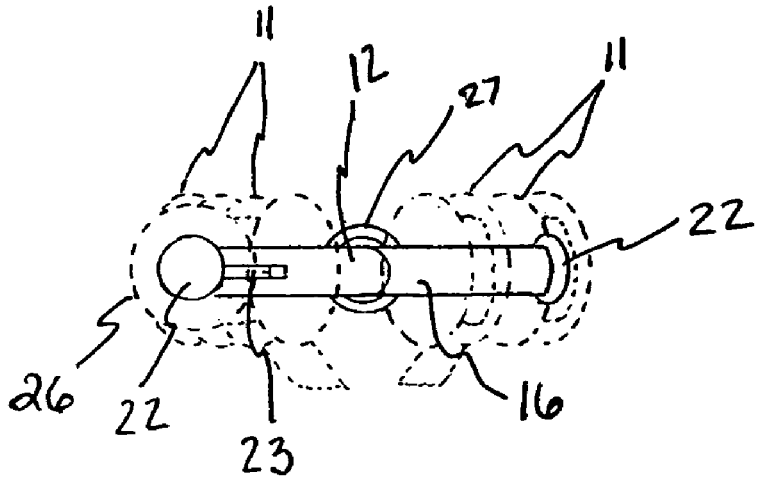

Unless defined otherwise, all terms used herein have the same meaning as are commonly understood by one of skill in the art to which this invention belongs. All patents, patent applications and publications referred to throughout the disclosure herein are incorporated by reference in their entirety. In the event that there is a plurality of definitions for a term herein, those in this section prevail.

The term "attachment means" as used herein refers to a means for securely, yet loosely holding decorative material rolls by a variety of methods known to one skilled in the art such as for example a tubular rod with an outside diameter less than the inside diameter of a roll of the decorative material with means of holding the roll on the rod, such as a screw-on cap, a press-on cap, a spring clip or a cotter pin.

The term "affixed" as used herein refers to a means for fastening or connecting, permanently or reversibly, one element of the invention to another element by a variety of methods known to one skilled in the art such as a T-shaped head may be affixed in place on the shaft by use of adhesive or by press-fitting the head onto the shaft.

The term "crank" as used herein refers to a means for rotating a shaft by a variety of methods known to one skilled in the art, such as for example, an offset handle, a knob, or items of a similar nature.

The terms "decorative material" or "decorative materials" as used herein refer to a variety of materials known to one skilled in the art commonly used for party decorations that are available in rolls, such as for example, but not limited to, streamer paper, ribbon, garland and the like or any other material on rolls that one may choose to twist and intertwine.

The term "gripping means" as used herein refers to a variety of mechanisms known to one skilled in the art for grasping or holding the device such as, for example, a slip-on-collar fitted over the shaft with ample clearance to allow free rotation of the shaft.

The terms "adapter" or "adapters" as used herein refer to a means for affixing items used in mounting decorative materials, such as a roll of adhesive tape or tacks, to the device of the invention. A variety of affixing means known to one skilled in the art may be used, such as for example, a spindle-shaped adapter affixed to the shaft which is able to hold a roll of adhesive tape or a handle adapter having a compartment for holding tacks.

The terms "storage means" and "means for storage" as used herein refer to a location or compartment for storing a reserve supply of materials that may be used in conjunction with the invention. A variety of such means known to one skilled in the art may be used, for example, creating a compartment within a hollow portion of the shaft having a removable cap that may be used to store thumb tacks for fastening decorative material to a structure.

The terms "structure" or "structures" as used herein refer to components of a house or a building, such as for example a wall, a ceiling, a door frame, a window frame or a patio cover, a deck, a light post, a fence, a tree, or other items of similar nature to which decorative material may be attached.

The present invention contemplates a variety of device constructions including a shaft 12 having two ends, an attachment means 16 provided on one end of the shaft 12 for holding one or more rolls 11 of decorative material, and a crank 14 provided on the other end of the shaft 12.

In other constructions the device 10 may further comprise a gripping means 25 positioned between the attachment means 16 and the crank 14, a storage means 21 for tacks or push pins, an adapter 23 for affixing at least one roll of adhesive tape 26 and/or a means for storage of one or more rolls of decorative material 11.

The shaft 12 may be constructed from a variety of materials known to one skilled in the art that provide sufficient strength and rigidity to prohibit excessive bending or flexing that may interfere with the operation. For example, the shaft 12 may be constructed of polymer plastic, high-density polymer, wood or metal. A preferred material is polyvinylchloride ("PVC"), a lightweight, inexpensive polymer that is commercially available. The shaft 12 may be constructed from solid stock material or hollow tubing stock material such as for example, cylindrical, square, rectangular, round-tubular, oval-tubular, square-box, rectangular-box; irregular or any combination thereof. Preferably the shaft 12 is constructed of a round tubular shaped stock material.

The length of the shaft 12 should be sufficient to allow the operator to grasp the shaft 12 in one hand and operate the crank 14 with the other hand when twisting the decorative material. Correspondingly one skilled in the art would recognize that the material used to construct the shaft 12 would depend on the length of the shaft 12. For example, if a length of 30 inches were desired, then a material that lends strength and rigidity to prevent bending of the shaft 12 during use would be desirable such as, for example, solid stock in PVC, wood or metal or tubular stock in thick walled PVC or metal. The shaft 12 may be provided in a variety of lengths not less than 6 inches and not more than 36 inches; preferably not less than 8 inches and not more than 24 inches and most preferably not less than 10 inches and not more than 18 inches. The shaft 12 may be provided in a variety of shapes known to one skilled in the art that might aid in the use of the device 10, preferably the shaft 12 is straight.

The shaft 12 may be provided in a variety of diameters. The diameter of the stock material used to construct shaft 12 may vary and will depend on the length of the shaft 12 desired. The shaft 12 must be of a thickness that imparts rigidity and strength to the shaft 12 to reduce bending during use. If the shaft 12 is constructed of solid stock material it may be provided in a diameter of not less than ½ inch and not more than 1½ inches. If the shaft 12 is constructed of tubular stock material, the outside diameter is preferably not less than ½ inch and not more than 2 inches; most preferably ½ nominal tubing having an outside diameter approximately 0.840 inch. Preferably, the thickness is not less than 1/16 inch and not more than 5/16 inch. Most preferably, the thickness will be that of a schedule 40 PVC tubing or approximately 0.109 inch thickness for the ½-inch nominal schedule 40 PVC pipe.

The attachment means 16 comprises elements for holding one or more rolls of decorative material 11 securely while allowing free rotation of the decorative material roll 11 so the decorative material may unravel easily from the roll. The elements of the attachment means 16 are affixed to one end of the shaft 12 at a position that allows intertwining and twisting of the decorative material as it unravels during rotation of the shaft 12. The attachment means 16 may be provided in a variety of configurations known to one skilled in the art. In one configuration the attachment means 16 comprises at least two rods 18 extending radially outward from the shaft 12 to hold the rolls of decorative material 11. The diameter of the rods 18 should be sufficiently less than the inside diameter of the rolls of decorative material 11 to allow free rotation while reducing wobble that could interfere with operation of the device 10. The ends of the rods 18 may further contain a securing means to retain the rolls of decorative material 11 on the rods 18 such as a press-on, screw-on or snap-on cap 22, spring clip or cotter pin.

The attachment means 16 may be connected to the shaft. 12 by a variety of methods know to one skilled in the art, for example, the connection may be provided by use of a tee fitting such as those commonly used to connect piping in a "T" configuration. In this configuration the rods 18 may be connected to the tee fitting by a variety of methods including the use of adhesive or by press fitting. Alternatively, the rods 18 and tee fitting may be form-molded as a single unit or the shaft 12 may be form molded to include a tee fitting on one end.

In the "T" shaped configuration the angle of the rods 18 to the shaft 12 may be not less than 90 degrees and not more than 135 degrees to increase the efficiency of the device 10 for intertwining and unraveling rolls of the decorative material 11. Preferably the angle is 90 degrees.

The rods 18 of the T-shaped attachment means 16 may be constructed of a variety of materials known to one skilled in the art including polymer plastic, high-density polymer, wood or metal in either a solid or tubular stock material. Preferably the attachment means 16 is constructed of the same material as the shaft 12. The rods 18 may be provided in a variety of shapes; including cylindrical, square, rectangular, round-tubular, oval-tubular, square-box, rectangular-box, irregular or any combination thereof. The round-tubular shape is preferred. The length of the rods 18 should be sufficient to hold at least one roll of decorative material 11. Preferably the length is not less than 1½ inches and not more than 12 inches. Most preferably, the length of each rod 18 is not less than 3 inches and not more than 6 inches.

The rods 18 may be provided in a variety of diameters. When the material is solid stock the outside diameter is preferably not less than ½ inch and not more than 1 inch. When the material is tubular stock the thickness of the rods 18 may vary depending on the length of the rods 18. The preferred thickness is one that may be determined by one skilled in the art to reduce flexing and bending during use able to accept rolls of decorative material 11 and allow easy rotation of the rolls on the rod 18 during use. Preferably, the thickness is not less than 1/16 inch and not more than 5/16 inch. Most preferably, the thickness will be the same as that of the shaft 12, in particular schedule 40 PVC tubing, which is approximately 0.109 inch thickness for the ½-inch nominal schedule 40 PVC piping.

The affixing of the rods 18 onto the attachment means 16 may be performed by a variety of methods known to one skilled in the art including for example, a single rod 18 having a length of not less than 5 inches and not greater than 20 inches may be inserted into a tee fitting such that the length of rod 18 extending beyond the fitting is equivalent on both sides. Alternatively, two rods 18 of a length not less than 2 inches and not greater than 12 inches may be inserted into a tee fitting, one on either side such that they are radially opposite each other. In another example, the rods 18 and the tee fitting are form molded as a single unit having an aperture able to receive the shaft 12 about equal distance from the ends of the rods 18. In another configuration, the tee fitting may have three or more apertures able to receive three or more rods 18 such that when in place, the rods 18 are generally perpendicular to the shaft 12. In this configuration, the angle of the rods 18 to the shaft 12 may be not less than 90 degrees and not more than 135 degrees to increase the efficiency of the device 10 for intertwining and unraveling rolls of decorative materials 11. Preferably the angle is 90 degrees.

The rods 18 may further comprise securing means for retaining the rolls of decorative material 11. A variety of securing means known to one skilled in the art may be provided including for example a cap affixed to the ends of the rods 18, such as a press-fit, screw-on or snap-on cap 22, a spring clip or a cotter pin.

The gripping means 25 of the device 10 is fitted over the shaft 12 and allows the user to securely grasp the device 10 while still allowing the shaft 12 to rotate when the crank 14 is operated. The gripping means 25 may be provided in a variety of shapes. Preferably the shape is similar to or adaptable to the shaft 12 so that the gripping means 25 fits loosely over the shaft 12, allowing free rotation of the shaft 12 when the operator holds the gripping means 25. The gripping means 25 is constructed of a material having a thickness that resists deformation when grasped by the user. Preferably the thickness is not less than 1/16-inch and not more than ¼-inch. The internal diameter is sufficient to allow free rotation of the shaft 12 within the gripping means 25 but not so large as to interfere with the user's ability to controllably rotate the shaft 12. The exterior of the gripping means 25 may be provided with a variety of shapes that allow for comfortable gripping during use. In addition, the gripping means 25 may further comprise a flexible cover that conforms to the user's hand when gripped such as for example a foam rubber sleeve that slips over the gripping means 25. A preferable size of the gripping means 25 is a nominal ¾-inch schedule 125-pipe size. The length of the gripping means 25 should be sufficient to provide an adequate grip by the operator. The length may be not less than 3 inches and not more than 18 inches; preferably from not less than 4 inches to not more than 10 inches; most preferably from not less than 4 inches to not more than 6 inches. Alternatively, the gripping means 25 may be provided as a slip collar constructed of two halves that may be snapped together over the shaft 12.

The gripping means 25 is preferably positioned in place between the attachment means 16 and the crank 14. More specifically, one end of the gripping means 25 is held in place by the attachment means adapter 23, which generally has an external diameter greater than the interior diameter of the gripping means 25. The other end of the gripping means 25 is held in place by the crank 14, which generally has an external diameter greater than the internal diameter of the gripping means 25. In one configuration the gripping means 25 is held in place between the attachment means 16 as stated above and the crank 14 formed on one end of the shaft 12 by bending the shaft 12 generally into the shape of the letter "Z".

The crank 14 provides a means for rotating the shaft 12 to intertwine and twist the unraveled, or unraveling, decorative material. The crank 14 may be provided in a variety of configurations known to one skilled in the art for example, the crank 14 may be an extension of the material used for construction of the shaft 12 formed in a way to provide an offset handle so that the operator may rotate the shaft 12. In one configuration one end of the shaft 12 may be bent in the general shape of the letter "Z" wherein the bend angles are not less than 30 degrees and not more than 120 degrees. Preferably the offset will be not less that ½-inch and not more than 12 inches. Most preferably, the offset will be approximately 2 inches. Alternatively, the crank 14 may be provided as a knob affixed to the shaft 12 that allows the user to rotate the shaft 12 by turning the knob.

The crank 14 may further comprise a flexible cover that conforms to the user's hand when gripped such as for example a foam rubber sleeve that may be fitted over the crank 14.

The device 10 may be used by first connecting the desired rolls of decorative material 11 to the rods 18 of the attachment means 16. This may require removal of a securing means such as a press-on cap or screw cap 22. The roll of decorative material 11 is slipped onto each rod 18 and secured by replacing the cap 22. A length of the decorative material is unraveled from each roll 11 and connected to a structure intended for decoration such as a wall or ceiling, using an affixing means such as a tack or pushpin. The device 10 is held by placing the gripping means 25 in one hand and the crank 14 in the other hand. The user then moves away from the connection point on the structure toward the desired second structure connecting point. When moving from the first connecting point to the second connecting point the decorative materials freely unravel from the rolls and are intertwined and twisted by turning the crank 14. The number of twists imparted to the decorative materials will depend on the desired appearance. Once the second connecting point is reached the twisted and intertwined decorative materials are disconnected from their respective rolls by tearing or cutting. The torn or cut ends are then secured to the structure by affixing means such as a tack or pushpin.

To facilitate decorating using the device 10, a storage means may be provided for equipment used in conjunction with the device 10. For example, tacks or pushpins are commonly used to affix decorative materials to structures when decorating. Storage means 21 for tacks or pushpins may be provided with the device 10 in a variety of configurations known to one skilled in the art. For example, when the shaft 12 is made of hollow tubing, a press fit cap 22 may be used on one end to allow for storage of tacks or pushpins. Alternatively, the tacks or pushpins may be stored in the hollow interior of the rod 18. A cap 22 or plug may be used to secure the, stored materials in the storage means 21, such as a press-on, snap-on, or screw cap 22. In another configuration, the attachment means 16 may be disconnected from the shaft 12 providing a storage area in the hollow section of the shaft 12. The attachment means 16 may be affixed to the shaft 12 by a screw-on or a press-on connection.

When the shaft 12 is made of solid stock material a storage means 21 may be affixed to the shaft 12 for holding equipment used in connection with the device 10 such as push pins or tacks. For example, a small container with a snap fit or press-on lid may be affixed to the shaft 12 either permanently such as with adhesive or by screw or reversibly such as by snap-on connection or Velcro™ to allow easy removal of the container if desired.

Another common means for affixing decorative materials to structures is adhesive tape 26. To enhance the functionality of the device 10, a means for storing adhesive tape 26 with the device 10 would assist the user when decorating. A means for storage of adhesive tape 26 may be provided by a variety of means known to one skilled in the art.

In one configuration an adapter 23 retains the adhesive tape 26 on the shaft 12, rod 18 or crank 14. The adapter 23 may be provided by a variety of means known to one skilled in the art for securing the adhesive tape 26 to the device 10 in such a way that the user may obtain a desired length of tape. For example, the adapter 23 may be constructed of a continuous or discontinuous ridge 24 around the exterior diameter of the shaft 12 and a depressible stop 28 having an angled shape wherein one edge of the stop is flush with the shaft 12 while the other end is raised above the shaft 12. The distance between the ridge 24 and the depressible stop 28 is approximately the width of the roll of adhesive tape 26 or some multiple thereof. The flush end of the depressible stop 28 is positioned away from the ridge 24. In this configuration the raised portion of the depressible stop 28 and the ridge 24 may be approximately the same height. In use the adhesive tape 26 is slipped over and down the shaft 12, rod 18 or crank 14 until reaching the flush end of the depressible stop 28. The adhesive tape roll 26 is then pushed over the stop depressing it and allowing the adhesive tape 26 to move up against the ridge 24. Once the adhesive tape 26 reaches the ridge 24 the stop returns to its non-depressed position reversibly locking the adhesive tape 26 in position. The adapter 23 may also be provided with a cutting edge for easy removal of a desired length of tape. When the adapter 23 further comprises a cutting edge the ridge 24 may be provided with an arm having a cutting edge that extends from the ridge 24 and around the roll of adhesive tape 26 positioning the cutting edge parallel to and facing the width of the adhesive tape 26. The cutting edge may be made of the same material as the arm sharpened for cutting adhesive tape or may be made of metal permanently affixed to the arm by adhesive or the like. One skilled in the art will recognize that in this configuration it would be preferable that the diameter of the stock material used to construct the shaft 12, rod 18 or crank 14 must be of a diameter less than that of a standard roll of adhesive tape 26. Further the diameter should be such that the roll of tape may be easily inserted onto the shaft 12, rod 18 or crank 14 allowing for rotation of the roll and easy removal of a desired length of adhesive tape 26.

A means for storage of a reserve supply of decorative material rolls 11 may be provided by a variety of means known to one skilled in the art. For example, an additional roll of decorative material 11 may be retained on the shaft 12, rod 18 or crank 14.

In one configuration an additional roll of decorative material 11 may be retained on the crank 14, for example, a continuous or discontinuous ridge may be provided around the exterior diameter of the crank 14 immediately adjacent to the gripping means 25. Further a press-on, snap-on or screw-on cap 22 may be provided on the end of the crank 14 having a diameter larger than that of the roll of decorative material 11. The space between the cap 22 and the ridge is approximately the width of a roll of decorative material or a multiple thereof. The additional decorative material roll 11 may be positioned on the crank 14 by removing the end cap 22 placing the additional roll of decorative material 11 on the crank 14 up against the ridge and replacing the end cap 22. One skilled in the art would recognize that in this configuration the length of the crank 14 between the end cap 22 and the grip might vary to accommodate a desired number of additional rolls of decorative materials 11. In particular, if the width of the roll of decorative material 11 is 2 inches and it would be preferable to store two additional rolls of decorative materials 11 on the crank 14 that an length of between 4 inches and 5 inches may be desired between the end cap 22 and ridge.

Alternatively, an additional decorative material roll 11 may be retained on the shaft 12, for example, between the gripping means 25 and the crank 14 or between the attachment means 16 and the gripping means 25. In this configuration the crank 14 may have an end cap 22 that can be removed to allow a roll of decorative material 11 to be placed on the crank 14 and moved onto the shaft 12 near the gripping means 25. Alternatively, the attachment means 16 may be removable allowing a decorative material roll 11 to be placed on the shaft 12 between the gripping means 25 and the attachment means 16. In another configuration an additional decorative material roll 11 may be placed on a rod 18 next to a roll of decorative material 11 currently in use. In each configuration one skilled in the art would recognize that the length of the crank 14, shaft 12 or rod 18 may be provided in a variety of lengths desired for accommodating additional decorative material storage. For example, in the width of a decorative material roll 11 is 2 inches and it is desired to store two additional rolls 11 on the rods 18 then the rods 18 would be provided in a length between approximately 6 inches to 7 inches to accommodate the rolls of decorative materials 11 in use as well as those in storage.

The use of decorative material such as streamer paper, ribbon or garland for festive decorations has been popular for decades. The decorative material is often affixed to ceilings, walls and beams, trees, fences and the like, strung from one point to another often times having multiple strips arranged in a variety of directions. In addition, a variety of colors of such decorative materials are used that may be twisted to add a spiral appearance. The present invention provides a fast and easy method for decorating with these decorative materials.

The device 10 may be prepared for use by removing the end cap 22 of the crank 14 which may be held in place by a screw press or snap fitting to expose the storage means. Place the adhesive roll 11 onto the crank 14 moving it on the crank 14 to the shaft 12 over the depressible stop 28 and up against the ridge 24 assuring that the depressible stop 28 returns to its non-depressed position locking the adhesive tape 26 in position for use. Deposit a desired number of affixing means such as tacks or pushpins in the storage means container within the crank 14 then replace the end cap 22. Remove the securing means on the ends of the rods 18 placing stored decorative material rolls 11 closest to the shaft 12 with decorative material rolls 11 to be used next. Replace the securing means, which may be screw, press, or snap fit caps 22 on the ends of the rods 18. Affix the gripping means 25 in position between the crank 14 and the attachment means 16 on the shaft 12. Preferably, the gripping means 25 is a slip collar provided in two halves that may be snap fit around the shaft 12. The device 10 may be operated as provided above.

I claim:

1. A device for dispensing and twisting decorative material from rolls comprising in the following order:

a shaft having two ends;

an attachment means for affixing securely yet loosely at least one roll of decorative material to be dispensed provided on one end of said shaft such that said attachment means rotates with said shaft during use, wherein said attachment means comprises two or more rods positioned about perpendicular to said shaft where each of said two or more rods having means for securing for holding one or more rolls of decorative materials for dispensing on each of said rods;

and means for gripping positioned between said attachment means and a crank wherein said means for gripping is rotatably affixed about said shaft and said crank is provided on the other end of said shaft.

2. A device according to claim 1 wherein said means for securing is selected from the group consisting of a screw-on cap, a press-on cap, snap-on cap, a spring clip and cotter pin.

3. A device according to claim 1 wherein said attachment means comprises rods extending outward from said shaft at an angle not greater than 135 degrees from said shaft.

* * * * *